US009877358B2

(12) United States Patent
Feng et al.

(10) Patent No.: US 9,877,358 B2
(45) Date of Patent: Jan. 23, 2018

(54) HEATING PAD

(71) Applicants: Tsinghua University, Beijing (CN); HON HAI PRECISION INDUSTRY CO., LTD., New Taipei (TW)

(72) Inventors: Chen Feng, Beijing (CN); Xue-Wei Guo, Beijing (CN); Li Qian, Beijing (CN); Yu-Quan Wang, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 324 days.

(21) Appl. No.: 13/866,232

(22) Filed: Apr. 19, 2013

(65) Prior Publication Data

US 2013/0284718 A1 Oct. 31, 2013

(30) Foreign Application Priority Data

Apr. 28, 2012 (CN) ..... 2012 1 0130027

(51) Int. Cl.
*H05B 3/14* (2006.01)
*H05B 3/34* (2006.01)

(52) U.S. Cl.
CPC ..... *H05B 3/145* (2013.01); *H05B 3/34* (2013.01); *H05B 2203/011* (2013.01); *H05B 2203/016* (2013.01); *H05B 2214/04* (2013.01)

(58) Field of Classification Search
CPC .... H05B 1/0272; H05B 1/0238; H05B 3/145; H05B 3/342; H05B 3/347; H05B 2214/04; H05B 2203/011; H05B 3/34; H05B 3/03; H05B 3/36
USPC ..... 219/541, 543, 528, 529, 545–549, 217, 219/539, 553, 538; 977/742, 843, 902; 472/122
See application file for complete search history.

(56) References Cited

U.S. PATENT DOCUMENTS 2,858,410 A * 10/1958 Rich ..... 219/539
3,407,096 A * 10/1968 Landi ..... 429/498
3,584,198 A * 6/1971 Doi ..... B32B 37/153 219/528

(Continued)

FOREIGN PATENT DOCUMENTS

CN 101605409 12/2009
CN 101605409 A * 12/2009

(Continued)

OTHER PUBLICATIONS

CN 101605409 A—Machine Translation, translated Feb. 20, 2015.*
C.N. 101605409 A Machine Translation (Translated Jun. 11, 2015).*

*Primary Examiner* — Joseph M Pelham
(74) *Attorney, Agent, or Firm* — ScienBiziP, P.C.

(57) ABSTRACT

A heating pad includes a heating element, a number of first electrodes and a plurality of second electrodes. The heating element includes a flexible substrate and a carbon nanotube layer fixed on the flexible substrate. The heating element has a first end and a second end opposite to the first end. The first end is cut into a number of first strip structures. The second end is cut into a number of second strip structures. Each of the first electrodes clamps one of the first strip structures and is electrically connected with the first strip structure. Each of the second electrodes clamps one of the second strip structures and is electrically connected with the second strip structure.

20 Claims, 8 Drawing Sheets

(56) References Cited

U.S. PATENT DOCUMENTS 3,808,403 A * 4/1974 Kanaya et al. ..... 219/528
4,459,470 A * 7/1984 Shlichta ..... H05B 3/84 219/543
4,684,785 A * 8/1987 Cole ..... 219/212
4,792,662 A * 12/1988 Kitagaki et al. ..... 219/545
5,288,973 A * 2/1994 Ota ..... G03G 15/2064 219/216
5,422,462 A * 6/1995 Kishimoto ..... H05B 1/0272 219/529
6,300,598 B1 * 10/2001 Chiles et al. ..... 219/213
6,627,689 B2 * 9/2003 Iino et al. ..... 524/404
7,261,782 B2 * 8/2007 Hwang ..... C22C 14/00 148/421
7,642,484 B2 * 1/2010 Gross et al. ..... 219/121.73
7,781,051 B2 * 8/2010 Burr et al. ..... 428/221
7,840,122 B1 * 11/2010 Hanrahan ..... A61M 11/041 219/538
8,183,755 B2 * 5/2012 Bang et al. ..... 313/313
8,367,881 B2 * 2/2013 Cheiky et al. ..... 585/240
8,492,682 B2 * 7/2013 Wang et al. ..... 219/553
8,791,394 B2 * 7/2014 Han et al. ..... 219/538
8,791,395 B2 * 7/2014 Chang ..... H05B 3/22 219/538
9,022,464 B2 * 5/2015 Feng et al. ..... 297/180.12
2003/0141498 A1 * 7/2003 Stasiak ..... H01L 51/0059 257/40
2005/0061801 A1 * 3/2005 Kuo et al. ..... 219/529
2005/0067406 A1 * 3/2005 Rajarajan ..... B82Y 30/00 219/553
2005/0242081 A1 * 11/2005 Howick ..... B60N 2/5685 219/529
2007/0056957 A1 * 3/2007 Diemer ..... B60N 2/5685 219/549
2007/0068548 A1 * 3/2007 Wong ..... A45D 1/04 132/232
2007/0068928 A1 * 3/2007 Augustine ..... A61B 19/08 219/528
2008/0053982 A1 * 3/2008 Ceva ..... A45D 1/04 219/225
2008/0170952 A1 * 7/2008 Jung ..... H02K 3/02 417/423.7
2008/0223841 A1 * 9/2008 Lofy ..... H05B 3/16 219/202
2008/0272110 A1 * 11/2008 Kamiyama et al. ..... 219/535
2009/0057296 A1 * 3/2009 Niemz et al. ..... 219/544
2009/0277897 A1 * 11/2009 Lashmore ..... H01B 1/04 219/544
2009/0321418 A1 12/2009 Feng et al.
2010/0000981 A1 * 1/2010 Diemer ..... H05B 3/146 219/202
2010/0021683 A1 * 1/2010 Junghans et al. ..... 428/116
2010/0078037 A1 * 4/2010 Mukai ..... A45D 1/04 132/223
2010/0122980 A1 * 5/2010 Wang et al. ..... 219/553
2010/0126985 A1 * 5/2010 Feng ..... H05B 3/145 219/553
2010/0200567 A1 8/2010 Liu et al.
2010/0206863 A1 * 8/2010 Ritter ..... 219/202
2010/0305504 A1 * 12/2010 Wang ..... A61M 5/44 604/114
2011/0056929 A1 * 3/2011 Feng et al. ..... 219/546
2011/0074380 A1 * 3/2011 Jeon ..... D03D 13/00 323/318
2011/0108545 A1 * 5/2011 Wang et al. ..... 219/546
2011/0200873 A1 * 8/2011 Hu ..... B32B 15/16 429/188
2011/0271424 A1 * 11/2011 Revol Cavalier ..... H01M 6/045 2/243.1
2012/0055914 A1 * 3/2012 Goto et al. ..... 219/217
2012/0125437 A1 * 5/2012 Okawara ..... H01L 31/048 136/259
2012/0125915 A1 * 5/2012 Wang ..... H05B 3/145 219/553
2012/0325798 A1 * 12/2012 Makino ..... 219/438
2013/0075386 A1 * 3/2013 Chang ..... H05B 3/34 219/538
2013/0186884 A1 * 7/2013 Barfuss et al. ..... 219/529

FOREIGN PATENT DOCUMENTS

DE 102011110973 A1 * 3/2012 ..... H05B 3/34
JP 200810354 1/2008
TW 201039676 11/2010

* cited by examiner

HEATING PAD

CROSS-REFERENCE TO RELATED APPLICATION

This application claims all benefits accruing under 35 U.S.C. § 119 from China Patent Application No. 201210130027.3, filed on Apr. 28, 2012, in the China Intellectual Property Office.

BACKGROUND

1. Technical Field

The present disclosure relates to a heating pad.

2. Description of Related Art

Currently, a heating pad is widely used in different fields such as a vehicle seat, a heating blanket, and a heating care belt. An electric resistance wire is commonly used as a heating element. Material of the electric resistance wire is usually metals or alloy of low tensile strength and low bending resistance. As a result, electric shocks can be caused by a breakage of the electric resistance wire. Therefore, a lifespan of the heating pad may be relatively short.

What is needed, therefore, is to provide a heating pad having a high tensile strength and a high bending resistance property.

BRIEF DESCRIPTION OF THE DRAWING

Many aspects of the present disclosure can be better understood with reference to the following drawings. The components in the drawings are not necessarily to scale, the emphasis instead being placed upon clearly illustrating the principles of the present embodiments.

DETAILED DESCRIPTION

The disclosure is illustrated by way of example and not by way of limitation in the figures of the accompanying drawings in which like references indicate similar elements. It should be noted that references to "another," "an," or "one" embodiment in this disclosure are not necessarily to the same embodiment, and such references mean at least one.

Figure 1:
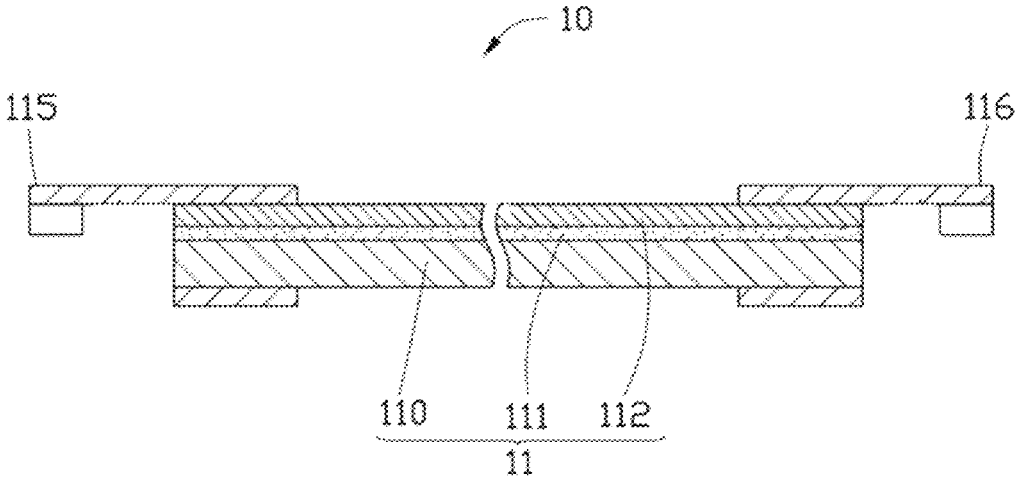
FIG. 1 shows a cross-section schematic view of one embodiment of a heating pad.
Figure 2:
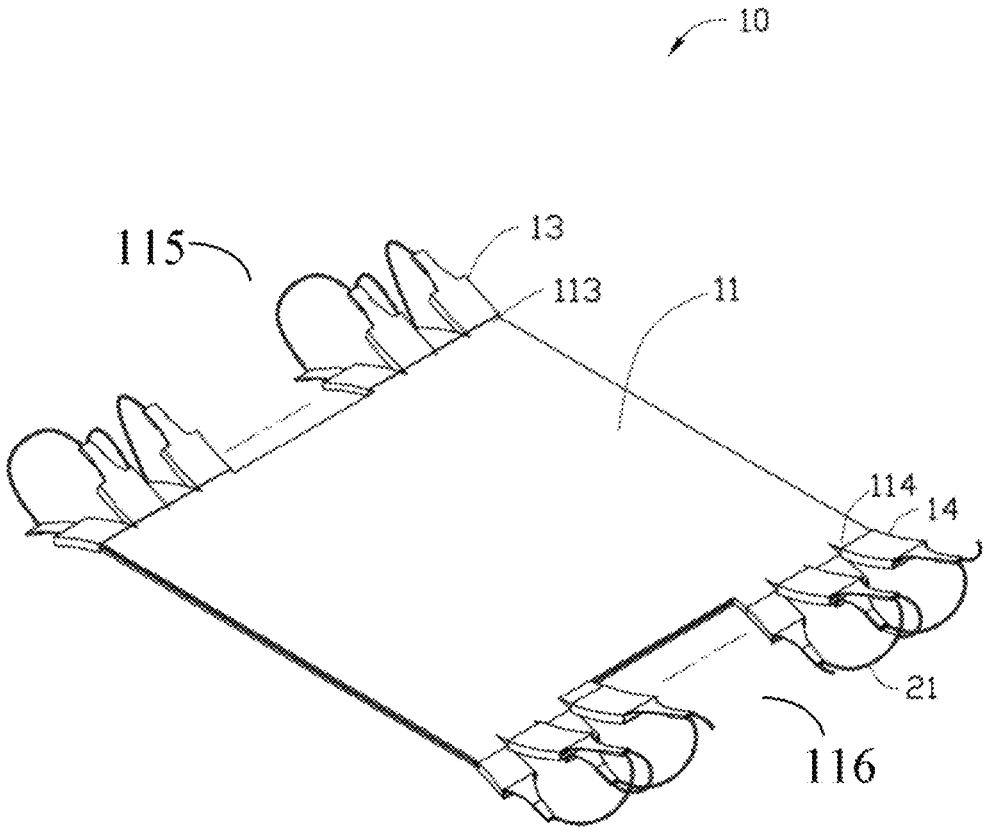
FIG. 2 shows a partial three-dimensional schematic view of the heating pad of the FIG. 1.
Figure 6:
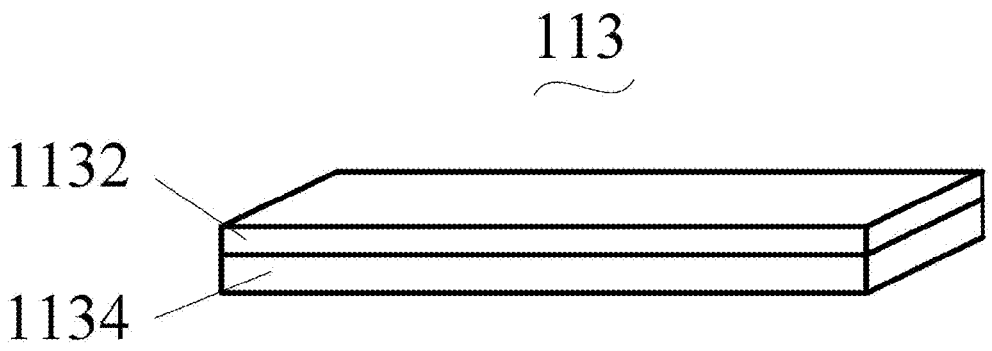
FIG. 6 is a schematic view of one embodiment of a first strip structures.
Figure 7:
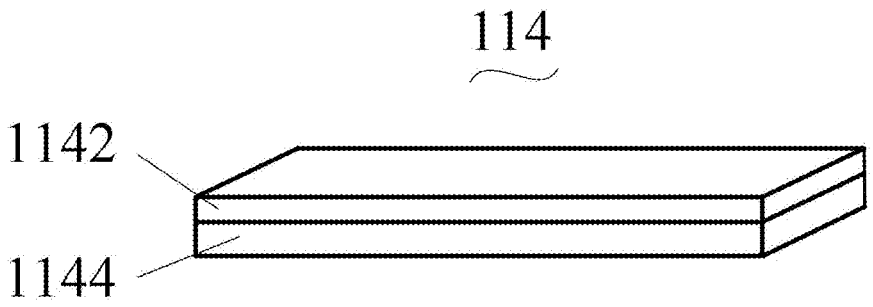
FIG. 7 is a schematic view of one embodiment of a second strip structures.
Figure 8:
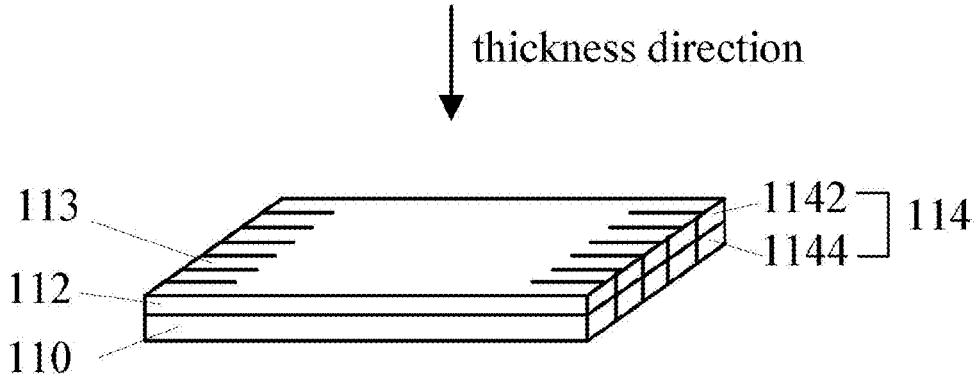
FIG. 8 is a schematic view of one embodiment of a heating element when the plurality of first strip structures is in the same plane.

FIGS. 1 and 2 show one embodiment of a heating pad 10 includes a heating element 11, a plurality of first electrodes 13 electrically connected with each other and a plurality of second electrodes 14 electrically connected with each other. The heating element 11 includes a flexible substrate 110, an adhesive layer 111 disposed on the flexible substrate 110, and a carbon nanotube layer 112 stuck on the flexible substrate 110 by the adhesive layer 111. The heating element 11 has a first end 115 and a second end 116 opposite to the first end 115. The first end 115 is divided into a plurality of first strip structures 113. When the first end 115 is divided into a plurality of first strip structures 113, the first substrate end of the flexible substrate 110 is also divided into a plurality of first flexible substrate strips 1134, and a first layer end of the carbon nanotube layer 112 is also divided into a plurality of first carbon nanotube strips 1132, as shown in FIG. 6. Each of the first electrodes 13 clamps and is electrically connected with one of the first strip structures 113. The second end 116 is divided into a plurality of second strip structures 114. When the second end 116 is divided into a plurality of second strip structures 114, the second substrate end of the flexible substrate 110 is also divided into a plurality of second flexible substrate strips 1144, and a second layer end of the carbon nanotube layer 112 is also divided into a plurality of second carbon nanotube strips 1142, as shown in FIG. 7. Each of the second electrodes 14 clamps and is electrically connected with one of the second strip structures 114. Each of the plurality of first strip structures 113 includes a first flexible substrate strip 1134 and a first carbon nanotube strip 1132, and adjacent two of the plurality of first carbon nanotube strips 1132 are in direct contact with each other when the plurality of first strip structures 113 is in a same plane, as shown in FIG. 8. Each of the plurality of second strip structures 114 includes a second flexible substrate strip 1144 and a second carbon nanotube strip 1142, and adjacent two of the plurality of second carbon nanotube strips 1142 are in direct contact with each other when the plurality of second strip structures 114 is in a same plane, as shown in FIG. 8.

A material of the flexible substrate 110 can be a flexible insulating material having an excellent ductility and a high strength, such as silica gel, polrvinyl chloride (PVC), polytetrafluoroethylene (PTFE), non-woven fabric, polyurethane (PU), or corium. In one embodiment, the flexible substrate 110 is a rectangle shaped PU substrate having a length of about 40 centimeters (cm) and a width of about 30 cm.

In one embodiment, the adhesive layer 111 is a silica gel layer. The carbon nanotube layer 112 is adhered on a surface of the flexible substrate 110 by the silica gel layer. The silica gel in the adhesive layer 111 is infiltrated between the adjacent carbon nanotubes in the carbon nanotube layer 112.

The carbon nanotube layer 112 includes at least one carbon nanotube film. In one embodiment, the carbon nanotube layer 112 includes more than one carbon nanotube films, such as 10 to 1000 carbon nanotube films stacked with each other. In one embodiment, the carbon nanotube layer 112 comprises two hundred carbon nanotube films 12 stacked with each other and combined with each other by van der Waals attractive force. An angle $\alpha$ between the carbon nanotubes in the adjacent carbon nanotube films can be in a range from about 0° C. to about 90° C. In one embodiment, the angle $\alpha$ is 0° C., namely the carbon nanotubes in the adjacent carbon nanotube films are aligned along a substantially same direction, and an extend direction of the carbon nanotubes in the carbon nanotube layer 112 is the same as a length direction of the flexible substrate 110.

Figure 3:
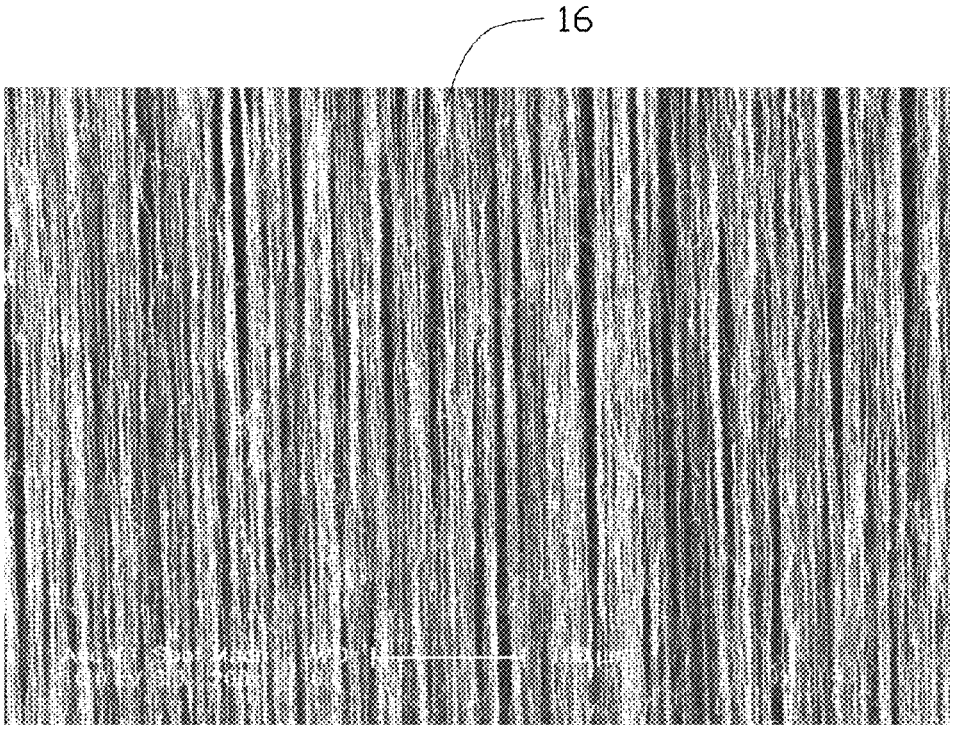
FIG. 3 shows a scanning electron microscopic image of a carbon nanotube film in the heating pad of the FIG. 1.

Referring to FIG. 3, the carbon nanotube film 16 is a free-standing structure. A large number of the carbon nanotubes in the carbon nanotube film can be oriented along a preferred orientation, meaning that a large number of the carbon nanotubes in the carbon nanotube film 16 are arranged substantially along the same direction. The arranged orientations of a large number of the carbon nanotubes are substantially parallel to the surface of the carbon nanotube film 16. An end of one carbon nanotube is joined to another end of an adjacent carbon nanotube arranged substantially along the same direction by van der Waals attractive force. A small number of the carbon nanotubes are randomly arranged in the carbon nanotube film 16, and has a small if not negligible effect on the larger number of the carbon nanotubes in the carbon nanotube film 16 arranged substantially along the same direction. The carbon nanotube film is capable of forming a free-standing structure. The term "free-standing structure" can be defined as a structure that does not have to be supported by a substrate. For example, a free-standing structure can sustain the weight of itself when it is hoisted by a portion thereof without any significant damage to its structural integrity. So, if the carbon nanotube film 16 is placed between two separate supporters, a portion of the carbon nanotube film 16, not in contact with the two supporters, would be suspended between the two supporters and yet maintain film structural integrity. The free-standing structure of the carbon nanotube film 16 is realized by the successive carbon nanotubes joined end to end by van der Waals attractive force. Microscopically, the carbon nanotubes oriented substantially along the same direction may not be perfectly aligned in a straight line, and some curve portions may exist. It can be understood that some carbon nanotubes located substantially side by side and oriented along the same direction in contact with each other cannot be excluded. More specifically, the carbon nanotube film 16 includes a plurality of successively oriented carbon nanotube segments joined end-to-end by van der Waals attractive force therebetween. Each carbon nanotube segment includes a plurality of carbon nanotubes substantially parallel to each other, and joined by van der Waals attractive force therebetween. The carbon nanotube segments can vary in width, thickness, uniformity and shape. The carbon nanotubes in the carbon nanotube film 16 are also substantially oriented along a preferred orientation.

The carbon nanotube film 16 has a great specific surface area, and there is no amorphous carbon and residual metal catalyst particles in the carbon nanotube film 16. Thus, the carbon nanotube layer 112 has a high viscosity, and the carbon nanotube layer 112 can be stuck on the flexible substrate 110 by the viscosity of the carbon nanotube layer 112 itself. Thus, the adhesive layer 111 is optional. The flexible substrate 110 and the carbon nanotube layer 112 are overlapped with each other.

The heating element 11 has the first end 115 and the second end 116 opposite to the first end 115. A direction from the first end 115 to the second end 116 is along a length direction of the heating element 11. In one embodiment, the first end 115 is cut into 43 first strip structures 113 along a direction substantially parallel to the length direction of the heating element 11. The second end 116 is cut into 43 second strip structures 114 along a direction substantially parallel to the length direction of the heating element 11. Thus, the first end 115 and the second end 116 are both divided into a plurality of parts separated from each other and all connected to the main body of the heating element 11. The first and second strip structures 113, 114 are belonged to the heating element 11. A width of the first strip structures 113 and the second strip structures 114 can be about 7 millimeters, and a length of the first strip structures 113 and the second strip structures 114 can be about 10 mm.

An end of an insert spring is fixed on one of the strip structures 113, 114 by a spring sheet. A conductive wire 21 is disposed on another end of the insert spring and clapped by the spring sheet. The insert springs fixed on the first strip structures 113 are electrically connected with each other by the conductive wires 21. The insert springs fixed on the second strip structures 114 are electrically connected with each other by the conductive wires 21. The insert springs can be used as the electrodes. Thus, a plurality of first electrodes 13 are electrically connected with one end of the heating element 11, and a plurality of second electrodes are electrically connected with another end of the heating element 11. A contact resistance between the electrodes and the carbon nanotube layer 112 is less than or equal to 0.3 Ohm. In one embodiment, the contact resistance is 0.1 Ohm. The carbon nanotubes in the heating pad 10 are joined with each other end to end by van der Waals attractive force such that jointly extend from the first electrodes 13 to the second electrodes 14. In one embodiment, the carbon nanotubes in the heating pad 10 are aligned along an aligned direction of the first electrodes 13 and the second electrodes 14. Specifically, the first electrodes 13 and the second electrodes 14 are connected with the carbon nanotubes along a diameter direction of the carbon nanotubes.

The strip structures of each end of the heating element 11 can be arranged with no gaps therebetween along a direction perpendicular to the length direction of the heating element 11. In one embodiment, the plurality of first electrodes 13 are separated from each other along a thickness direction of the heating element 11, and the plurality of second electrodes 14 are separated from each other along a thickness direction of the heating element 11. Some or all of the first and second electrodes 13, 14 can be diverged from the plane of the heating element 11.

Figure 4:
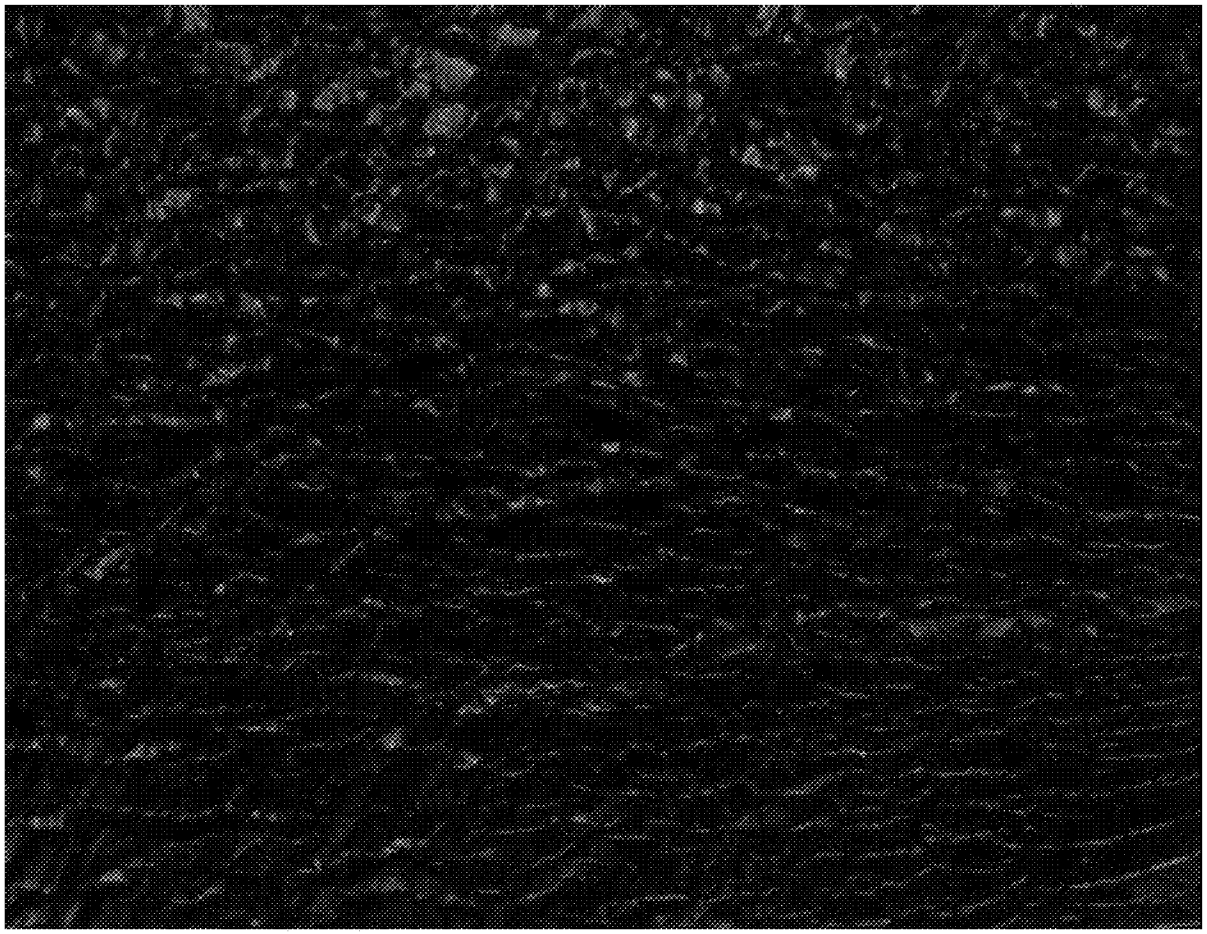
FIG. 4 is a photo of a side surface of a carbon nanotube layer in another embodiment of a heating pad.
Figure 5:
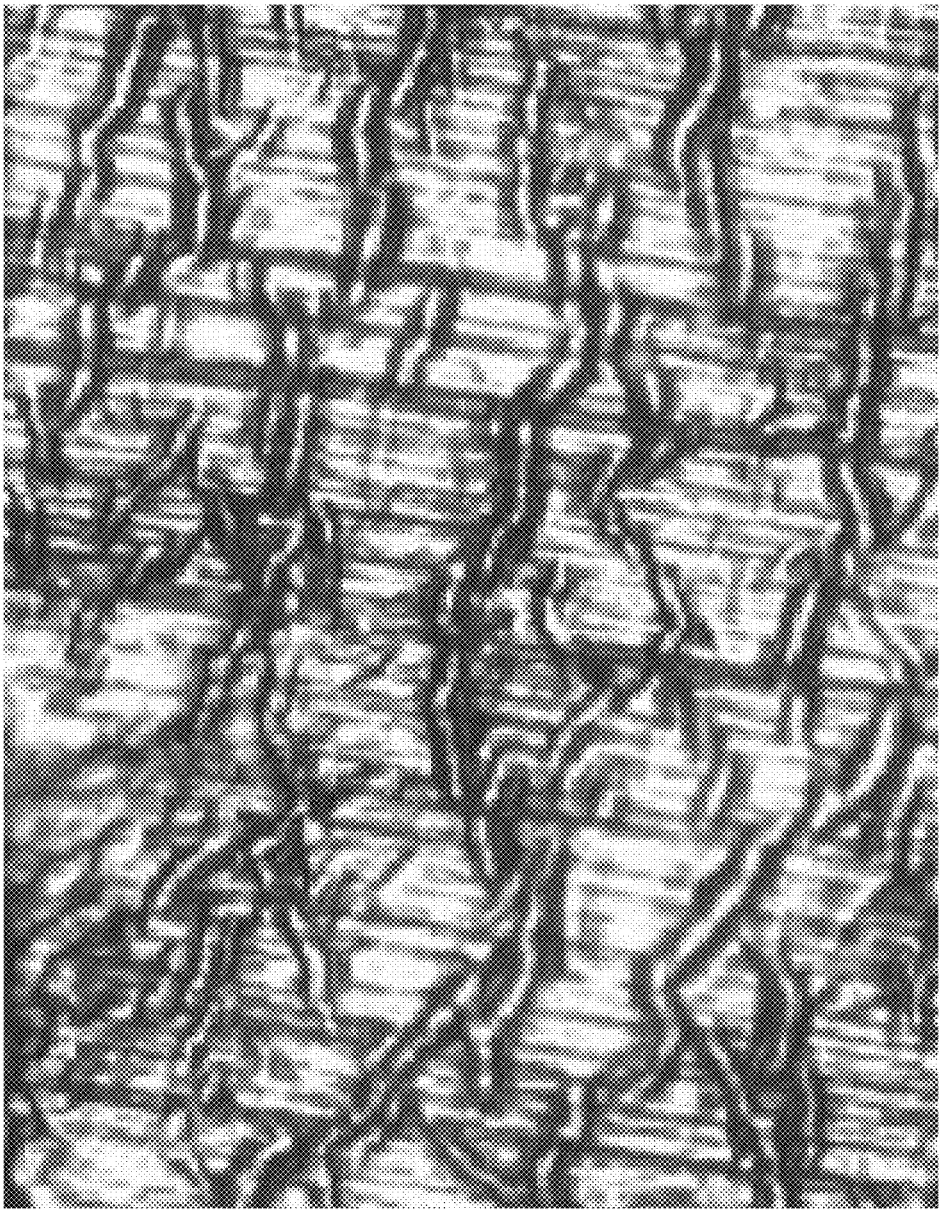
FIG. 5 is an optical microscopic image of the side surface of the carbon nanotube layer of FIG. 4.

Referring to FIGS. 4 and 5, in another embodiment, the carbon nanotubes in the carbon nanotube layer bend along a normal direction of the carbon nanotube layer and form a plurality of protuberances. Namely, in a single carbon nanotube, portions of the carbon nanotube are higher than other portions of the carbon nanotube. Macroscopically, the carbon nanotube layer includes a plurality of wrinkles due to the protuberances of the carbon nanotubes. An extending direction of the wrinkles can be crossed with the extending direction of the carbon nanotubes in the carbon nanotube layer. Referring to FIG. 5, in one embodiment, the extending direction of the wrinkles is substantially perpendicular to the length direction of the heating element 11. The heating element 11 has a drawing margin in the length direction of the heating element 11. A resistance of the heating element in the extend direction of the carbon nanotube is about 5.4 Ohm.

The flexible substrate 110 is flexible, and the heating element 11 has the drawing margin in the length direction of the heating element. If the heating element 11 is drawn along the length direction of the heating element, the carbon nanotubes in the carbon nanotube layer cannot easily break. In addition, the carbon nanotube layer has an excellent tensile strength in the direction substantially perpendicular to the extending direction of the carbon nanotubes. Thus, the heating element has a high tensile strength, a high bending resistance performance and a high mechanical strength.

In one embodiment, the heating element can be formed by the following steps:

S1, applying an external force on the PU, thereby the PU being drawn to 44 cm in the length direction;

S2, coating the silica gel on the surface of the PU to form a silica gel layer;

S3, disposing the carbon nanotube layer including 200 carbon nanotube films stacked with each other on the PU to form a carbon nanotube prefabricated structure;

S4, removing the external force applied on the PU to form the carbon nanotube layer.

In the step S1, a deformation of percentage 10 of the PU is induced by the drawing. In the step S4, the PU is shrunk to 40 cm in the length direction after removing the external force, and the carbon nanotube prefabricated structure is also shrunk with the shrinkage of the PU to form the carbon nanotube layer. The carbon nanotubes in the carbon nanotube layer are bent into a plurality of protuberances along the normal direction of the carbon nanotube layer. Thus, the carbon nanotube layer includes a plurality of wrinkles.

In use, a voltage of 56.4 V and a current of 10.16 A are applied on the heating pad. The test results shows as follows:

TABLE 1

| Conduction period | A temperature difference between the heating pad and the circumstance |
|---|---|
| 15 s | 16° C. |
| 30 s | 31° C. |
| 60 s | 62° C. |

The carbon nanotubes in the carbon nanotube layer have an excellent conductivity along an axis direction of the carbon nanotubes. The resistance of the heating element in the length direction of the carbon nanotubes is about 5.4 Ohm. A contact resistance between the electrodes and the heating element 11 is about 0.1 Ohm. Thus, a temperature of the heating pad can be rapidly risen within a short period. Thus, the heating pad can rapidly heat other substances under a certain power.

In another embodiment, a heat insulating property of the heating pad is tested under a small power input. A voltage of 12 V and a current of 2.18 A is applied on the heating pad. A conduction period and a temperature of the heating pad are tested under a room temperature of 26.4° C. The results are shown as follows:

TABLE 2

| Conduction period | Temperature of the heating pad |
|---|---|
| 0 s | 26.4° C. |
| 30 s | 27.7° C. |
| 60 s | 29.2° C. |
| 1 min 30 s | 30.7° C. |
| 2 min | 32.0° C. |
| 2 min 30 s | 33.1° C. |
| 3 min | 34.0° C. |
| 3 min 30 s | 34.9° C. |
| 4 min | 35.6° C. |
| 4 min 30 s | 36.3° C. |
| 5 min | 36.9° C. |
| 6 min | 37.8° C. |
| 7 min | 38.4° C. |
| 8 min | 38.7° C. |
| 9 min | 39.3° C. |
| 10 min | 39.4° C. |
| 11 min | 39.9° C. |
| 12 min 16 s | 40.2° C. |
| 15 min 38 s | 40.4° C. |
| 29 min 48 s | 41.0° C. |

It is shown in Table. 2, the temperature of the heating pad can be slowly risen to a value range under a small power input. The temperature of the heating pad can be kept in the range for a period.

In another embodiment, a voltage of 24 V and a current of 4.29 A are applied on the heating pad. A conduction period and a temperature of the heating pad are tested under a room temperature of 25.6° C. The results are shown in table 3 as follows:

TABLE 3

| Conduction period | Temperature of the heating pad |
|---|---|
| 0 s | 25.5° C. |
| 30 s | 27.9° C. |
| 60 s | 33.2° C. |
| 1 min 30 s | 38.4° C. |
| 2 min | 42.8° C. |
| 3 min | 50.8° C. |
| 4 min | 56.0° C. |
| 5 min | 59.9° C. |
| 6 min | 61.4° C. |
| 7 min | 63.0° C. |
| 16 min | 66.6° C. |
| 17 min | 67.2° C. |

It can be clearly seen from Table 3 that the greater the power, the greater the rising speed of the temperature of the heating pad, and the higher the temperature of the heating pad.

A material of the flexible substrate can be a heat shrinkage material. The heat shrinkage material can be shrunk by heating. The heat shrinkage material can be acrylonitrile-butadiene-styrene (ABS), Ethylene vinyl-acetate copolymer (EVA), polyethylene glycol terephthalate (PET), or polyolefin. In one embodiment, the heat shrinkage material is polyolefin. The flexible substrate is made by bombarding a cross-linked polyolefin using a high-power electrode beam. A shrinkage ratio of the flexible substrate can be 50%. A shrinkage temperature of the flexible substrate can be in a range from about 84° C. to about 120° C., the work temperature can be in a range from about −55° C. to about 125° C.

In one embodiment, the heating element can be made by the following steps: M1, coating the silica gel on the surface of the flexible substrate to form a silica gel layer; M2, disposing the carbon nanotube layer including 200 carbon nanotube films stacked with each other on the flexible substrate to form the carbon nanotube prefabricated structure; M3, heating the flexible substrate. In the step M3, the carbon nanotube prefabricated structure is shrunk with the shrinkage of the flexible substrate to form the carbon nanotube layer. The carbon nanotubes in the carbon nanotube layer are bent into a plurality of protuberances along a normal direction of the carbon nanotube layer. Thus, the carbon nanotube layer includes a plurality of wrinkles. Thus, the carbon nanotube layer has a drawing allowance along the extend direction of the carbon nanotubes.

The structure of the heating pad is not limited, and the contact resistance between the electrodes and the carbon nanotube layer can be less than or equal to 0.3 Ohm. Thus, the temperature of the heating pad can be rapidly risen and is kept at a stable value.

The heating pad can be applied in a vehicle seat, an electric heating blanket, a heating care belt, a movie theater, or other entertainment venues.

The carbon nanotube layer and the flexible substrate have an excellent flexibility, thus, the heating pad is a flexible heating pad. In addition, the carbon nanotubes in the carbon nanotube layer has the excellent conduction along the axis of the carbon nanotubes. Thus, the heating element has the small resistance on the extending direction of the carbon nanotubes. In addition, the contact resistance between the carbon nanotube layer and the electrodes is small, thus, the work power of the heating pad is small, and the increasing speed of the temperature of the heating pad is large. The carbon nanotubes in the carbon nanotube layer are bent into a plurality of protuberances along a normal direction of the carbon nanotube layer. Thus, the carbon nanotube layer includes a plurality of wrinkles. The carbon nanotube layer has an excellent tensile strength in the direction substantially perpendicular to the extending direction of the carbon nanotubes. Thus, the heating element has a high tensile strength, a high bending resistance performance and a high mechanical strength.

Depending on the embodiment, certain steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

Finally, it is to be understood that the above-described embodiments are intended to illustrate rather than limit the present disclosure. Variations may be made to the embodiments without departing from the spirit of the present disclosure as claimed. Elements associated with any of the above embodiments are envisioned to be associated with any other embodiments. The above-described embodiments illustrate the scope of the present disclosure but do not restrict the scope of the present disclosure.

What is claimed is:

1. A heating pad, comprising:

a heating element comprising a flexible substrate and a carbon nanotube layer overlapped with each other, the heating element has a first end, divided into a plurality of first strip structures, the flexible substrate comprises a plurality of first flexible substrate strips, and the carbon nanotube layer comprises a plurality of first carbon nanotube strips; each of the plurality of first strip structures comprises one of the plurality of first flexible substrate strips and one of the plurality of first carbon nanotube strips, and adjacent two of the plurality of first carbon nanotube strips are in direct contact with each other when the plurality of first strip structures is in a same plane; and a plurality of first electrodes disposed on the first end.

2. The heating pad of claim 1, wherein each of the plurality of first electrodes is a metal insert spring, and each of the plurality of first strip structures is inserted into one metal insert spring.

3. The heating pad of claim 1, wherein the plurality of first electrodes are separated from each other along a thickness direction of the heating element.

4. The heating pad of claim 1, wherein a contact resistance between each of the plurality of first electrodes and the carbon nanotube layer is less than or equal to 0.3 Ohm.

5. The heating pad of claim 1, wherein the carbon nanotube layer comprises a plurality of carbon nanotube films stacked with each other, each of the plurality of carbon nanotube films comprises a plurality of carbon nanotubes, and the plurality of carbon nanotubes in adjacent two of the plurality of carbon nanotube films are arranged along a same direction.

6. The heating pad of claim 1, wherein a material of the flexible substrate is selected from the group consisting of silicon rubber, polyvinyl chloride, polytetrafluoroethylene, non-woven, fabric polyurethane, corium, and any combination thereof.

7. The heating pad of claim 1, wherein a material of the flexible substrate is a heat shrinkage material.

8. The heating pad of claim 1, wherein each of the plurality of first electrodes is an insert spring, an end of the insert spring is fixed on one of the plurality of first strip structures by a spring sheet, and a conductive wire is disposed on another end of the insert spring and clapped by the spring sheet.

9. The heating pad of claim 1, wherein the carbon nanotube layer defines a plurality of wrinkles.

10. The heating pad of claim 8, wherein the carbon nanotube layer comprises a plurality of carbon nanotubes joined with each other end to end, and the plurality of wrinkles are protuberance formed by bending the plurality of carbon nanotubes.

11. The heating pad of claim 9, wherein an extend direction of the wrinkles is crossed with an extending direction of the plurality of carbon nanotubes.

12. The heating pad of claim 9, wherein an extend direction of the wrinkles is substantially perpendicular with an extending direction of the plurality of carbon nanotubes.

13. A heating pad, comprising:

a heating element comprising a flexible substrate and a carbon nanotube layer overlapped with each other, and the heating element has a first end and a second end opposite to the first end; the first end is divided into a plurality of first strip structures, the second end is divided into a plurality of second strip structures, the flexible substrate comprises a plurality of first flexible substrate strips and a plurality of second flexible substrate strips, and the carbon nanotube layer comprises a plurality of first carbon nanotube strips and a plurality of second carbon nanotube strips; each of the plurality of first strip structures comprises one of the plurality of first flexible substrate strips and one of the plurality of first carbon nanotube strips, and adjacent two of the plurality of first carbon nanotube strips are in direct contact with each other when the plurality of first strip structures is in a same plane; and each of the plurality of second strip structures comprises one of the plurality of second flexible substrate strips and one of the plurality of second carbon nanotube strips, and adjacent two of the plurality of second carbon nanotube strips are in direct contact with each other when the plurality of second strip structures is in a same plane;

a plurality of first electrodes clamp the plurality of first strip structures and electrically connected with the plurality of first strip structures in one to one manner; and a plurality of second electrodes clamp the plurality of second strip structures and electrically connected with the plurality of second strip structures in one to one manner.

14. The heating pad of claim 13, wherein the plurality of first electrodes are electrically connected with each other by conductive wires, and the plurality of second electrodes are electrically connected with each other by conductive wires.

15. The heating pad of claim 13, wherein contact resistances between the plurality of first electrodes and the carbon nanotube layer, and between the plurality of second electrodes and the carbon nanotube layer are less than or equal to 0.3 Ohm.

16. The heating pad of claim 13, wherein the carbon nanotube layer comprises a plurality of carbon nanotubes extending from the plurality of first electrodes to the plurality of second electrodes of the heating element.

17. The heating pad of claim 13, wherein the carbon nanotube layer comprises a plurality of carbon nanotubes joined with each other end to end and extending along a direction from the plurality of first electrodes to the plurality of second electrodes.

18. The heating pad of claim 13, wherein the carbon nanotube layer defines a plurality of wrinkles.

19. The heating pad of claim 18, wherein the carbon nanotube layer comprises a plurality of carbon nanotubes joined with each other end to end, and the plurality of wrinkles are protuberance formed by bending the plurality of carbon nanotubes.

20. The heating pad of claim 18, wherein the carbon nanotube layer comprises a plurality of carbon nanotubes extending along a same direction, and an extend direction of the wrinkles is substantially perpendicular with an extending direction of the plurality of carbon nanotubes.

* * * * *